US008192309B1

(12) United States Patent
Roberts

(10) Patent No.: US 8,192,309 B1
(45) Date of Patent: Jun. 5, 2012

(54) HUNTING ARROW GAME TRACKING DEVICE

(76) Inventor: Leroy Paul Roberts, Ormond Beach, FL (US)

( * ) Notice: Subject to any disclaimer, the term of this patent is extended or adjusted under 35 U.S.C. 154(b) by 0 days.

(21) Appl. No.: 13/066,413

(22) Filed: Apr. 14, 2011

Related U.S. Application Data

(60) Provisional application No. 61/420,220, filed on Dec. 6, 2010.

(51) Int. Cl.
*F42B 6/04* (2006.01)

(52) U.S. Cl. ..... 473/578

(58) Field of Classification Search ..... 473/578, 473/582, 583, 585, 586
See application file for complete search history.

(56) References Cited

U.S. PATENT DOCUMENTS

| | | | | |
|---|---|---|---|---|
| 3,790,948 | A | 2/1974 | Ratkovich | |
| 4,340,930 | A * | 7/1982 | Carissimi | 362/204 |
| 4,858,935 | A | 8/1989 | Capson | |
| 4,885,800 | A | 12/1989 | Ragle | |
| 4,940,245 | A | 7/1990 | Bittle, Jr. | |
| 4,976,442 | A | 12/1990 | Treadway | |
| 5,024,447 | A | 6/1991 | Jude | |
| 5,167,417 | A | 12/1992 | Stacey et al. | |
| 5,188,373 | A | 2/1993 | Ferguson et al. | |
| 5,446,467 | A | 8/1995 | Willett | |
| 5,450,614 | A | 9/1995 | Rodriguez | |
| 6,409,617 | B1 | 6/2002 | Armold | |
| 6,612,947 | B2 | 9/2003 | Porter | |
| 6,814,678 | B2 | 11/2004 | Cyr et al. | |
| 6,856,250 | B2 | 2/2005 | Hilliard | |
| 7,232,389 | B2 | 6/2007 | Monteleone | |
| 7,331,887 | B1 | 2/2008 | Dunn | |
| 2010/0035709 | A1 | 2/2010 | Russell et al. | |

* cited by examiner

*Primary Examiner* — John Ricci
(74) *Attorney, Agent, or Firm* — Thomas C. Saitta

(57) ABSTRACT

A game tracking device used in combination with a hunting arrow, the device having an elongated adaptor insert positionable between the arrowhead and shaft of the hunting arrow, the insert being provided with a recess to receive a transmitter that emits a locator signal. A barb member extends forward from the transmitter housing, such that when a game animal is struck by the arrow, the transmitter separates from the arrow and remains embedded in the animal.

17 Claims, 2 Drawing Sheets

HUNTING ARROW GAME TRACKING DEVICE

This application claims the benefit of U.S. Provisional Patent Application Ser. No. 61/420,220, filed Dec. 6, 2010.

BACKGROUND OF THE INVENTION

This invention relates generally to the field of hunting arrows having means for tracking a wounded game animal that has been shot, and more particularly relates to such devices that comprise a signal transmitting component, and even more particularly to such devices wherein the signal transmitting component separates from the arrow and attaches to the animal.

When bow hunting game animals, it often occurs that an animal is hit by the arrow but is not immediately killed, in which case the hunter may lose sight of the animal as it runs away or hides. Larger game may travel miles after being wounded before dying. Tracking the wounded game by blood trail may be difficult or impossible, especially if the wound closes sufficiently such that little blood escapes.

A known solution to this problem is to provide a battery powered radio transmitter in combination with a hunting arrow, whereby the transmitter will emit a locator signal when the arrow has been shot, enabling the location and movement of the transmitter to easily be ascertained by the hunter using a radio tracking receiver. In some instances, the transmitter is incorporated into the shaft or head of the arrow during manufacture. This design is not optimal since in many instances the animal will shake loose the arrow as it escapes, or the arrow may pass completely through the animal. Thus an improved design incorporates a releasable transmitter in combination with the arrow, such that when the animal is struck the transmitter separates from arrow and securely attaches to the skin or tissue of the animal, typically using one or more barbs or hooks. In some embodiments the transmitter is mounted in or attached externally to the arrow head, in others the transmitter is mounted in or attached externally to the arrow shaft, and in others the transmitter is mounted in or attached externally to the nock. Examples of these known devices are shown in U.S. Pat. Nos. 3,790,948 to Ratkovich, 4,858,935 to Capson, 4,885,800 to Ragle, 4,940,245 to Bittle, Jr., 4,976,442 to Treadway, 5,024,447 to Jude, 5,167,417 to Stacey et al., 5,188,373 to Ferguson et al., 5,446,467 to Willett, 5,450,614 to Rodriguez, 6,409,617 to Armold, 6,612,947 to Porter, 6,814,678 to Cyr et al., 6,856,250 to Hilliard, 7,232,389 to Monteleone, and 7,331,887 to Dunn.

Many of these known game tracking hunting arrow designs and structures are not optimal. For example, such devices having the transmitter mounted externally to the head, shaft or nock of the arrow will cause inaccuracy in the flight path and aerodynamics of the arrow, causing it to fly off course or lose velocity. Those devices having the transmitters mounted in the heads, shafts or nocks of the arrow will likely eliminate these deficiencies, but such designs require the purchase of specialty heads, shafts or nocks, such that the hunter is not able to utilize conventional hunting arrows.

It is an object of this invention to provide a game tracking device adapted for use in combination with a conventional hunting arrow, the game tracking device comprising a battery powered radio transmitter that separates from the arrow and attaches itself to the game animal when the game animal is struck by the arrow, and wherein the transmitter is retained within an adaptor insert member positioned between the head and the shaft of a conventional arrow, the adaptor insert member being structured to correspondingly mate with the conventional male/female connectors that join the arrow head to the shaft.

SUMMARY OF THE INVENTION

The invention is a game tracking device used in combination with a conventional hunting arrow, the arrow having a head removably mounted onto a shaft, wherein the game tracking device comprises a battery powered radio transmitter releasably retained within a generally cylindrical adaptor insert member, the adaptor insert member comprising means for releasably connecting the adaptor insert member to and between the arrow head and the arrow shaft. In the preferred embodiment, the releasable connector means comprise a threaded male connector disposed in the rear of the main body of the adaptor insert member and a threaded female connector disposed in the front of the main body. The adaptor insert member is configured to present an aerodynamic shape that minimizes drag on the arrow. The transmitter comprises a generally cylindrical housing and a barb, whereby the housing is retained within an open-topped recess with the barb positioned externally to the adaptor and facing forward toward the arrow head. Preferably the housing is provided with a removable cap such that the transmitter battery can be replaced when necessary.

When the forward end of the arrow penetrates a game animal, the transmitter barb embeds in the skin or tissue, causing the transmitter housing to be pulled from the recess in the adaptor insert member as the arrow itself continues forward. In this manner the transmitter is retained on the animal independently of the arrow. The hunter, using a dedicated receiver, is then able to follow the tracking signal emitted by the transmitter in order to locate the wounded animal.

DETAILED DESCRIPTION OF THE INVENTION

Figure 1:
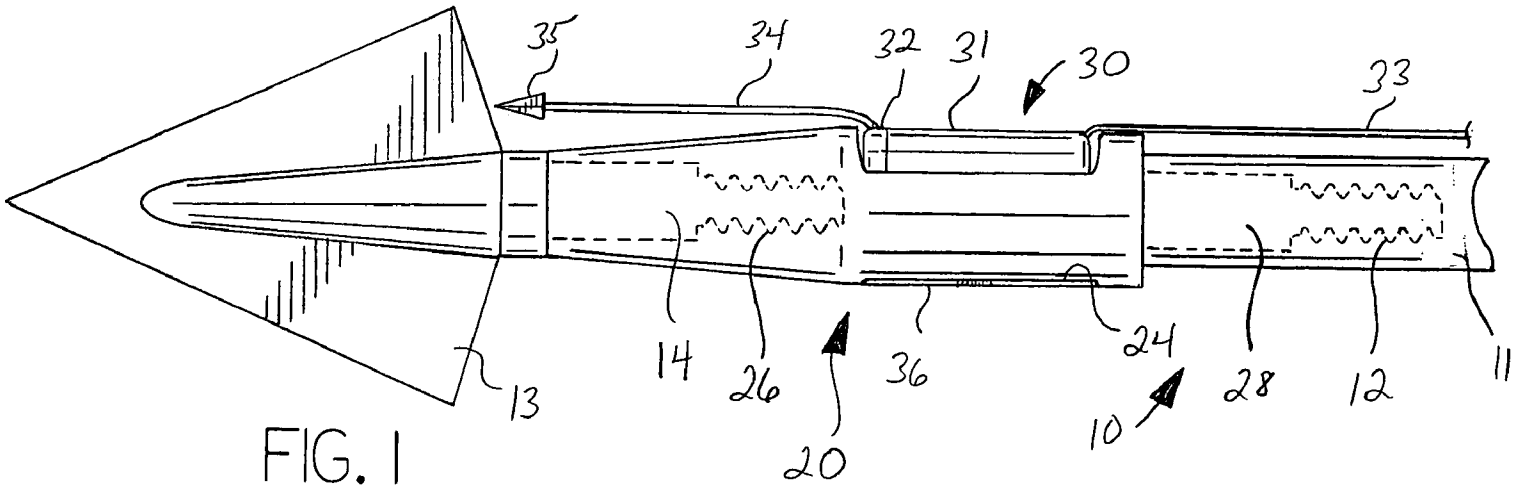
FIG. 1 is a side view of the game tracking device in combination with a conventional hunting arrow head and shaft.

With reference to the drawings, the invention in terms of the best mode and preferred embodiment will now be described in detail. In general the invention is a game tracking device adapted for use with a hunting arrow, or the combination of the game tracking device and arrow, wherein the game tracking device is a battery powered radio transmitter that emits a tracker or locator signal which is received by a radio receiver, the locator signal enabling the hunter to determine the location of the transmitter and thereby follow the wounded game animal.

A conventional hunting arrow 10 comprises an elongated cylindrical shaft 11 removably joined to an arrowhead 13. The arrowhead 13 is provided with rearward extending male connector means 14 for insertion into female connector means 12, and the front of the arrow shaft 11 is provided with female connector means 12 for releasably receiving the arrowhead connector means 14. Typically the arrowhead male connector means 14 comprises an externally threaded rod and the shaft connector means 12 comprises an internally threaded socket.

Figure 2:
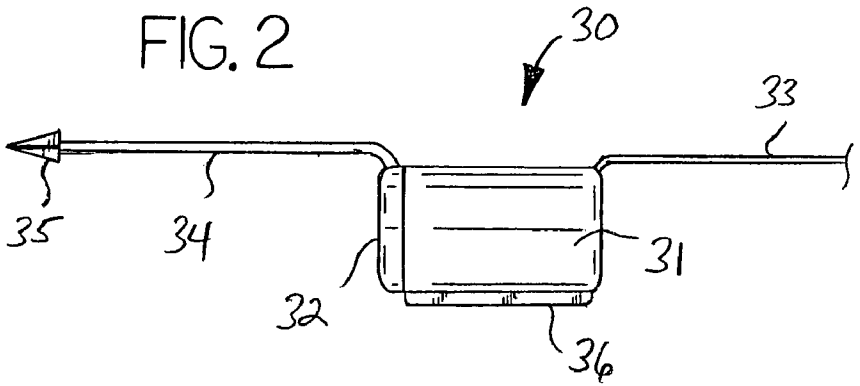
FIG. 2 is a side view of the battery powered radio transmitter.
Figure 3:
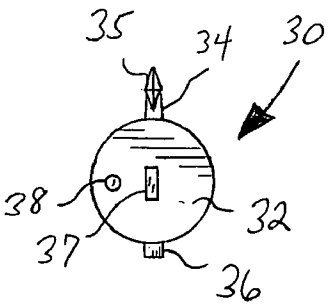
FIG. 3 is a front end view of the battery powered radio transmitter.
Figure 4:
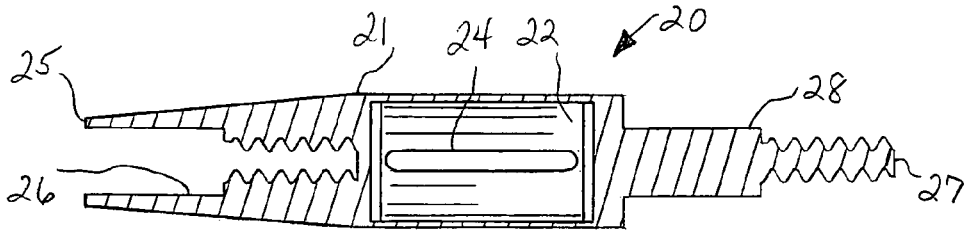
FIG. 4 is a cross-sectional top view of the adaptor insert member taken along line IV-IV of FIG. 6.
Figure 5:
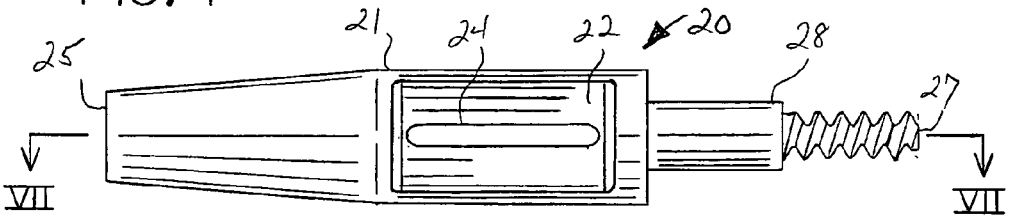
FIG. 5 is a top view of the adaptor insert member.
Figure 6:
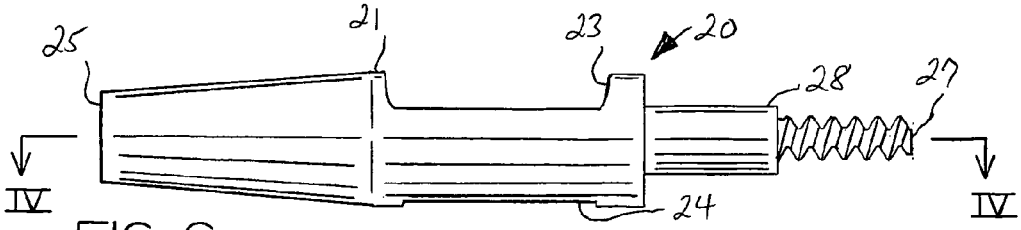
FIG. 6 is a side view of the adaptor insert member.
Figure 7:
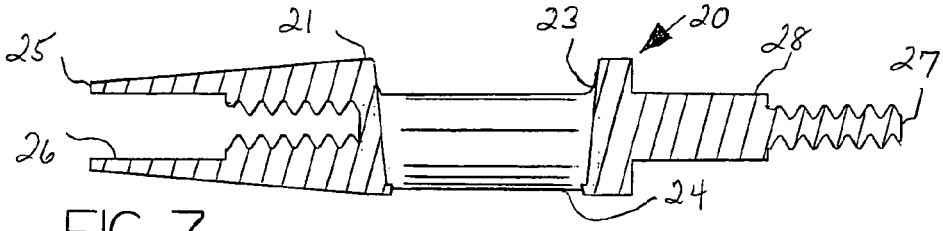
FIG. 7 is a cross-sectional side view of the adaptor insert member taken along line VII-VII of FIG. 5.

The game tracker device comprises a battery powered radio transmitter 30 and an adaptor insert member 20. Battery powered radio transmitters are well known in general, and the transmitter 30 of the invention may operate in conventional manner. As shown best in FIGS. 2 and 3, the radio transmitter 30 comprises a housing 31, shown as being generally cylindrical and slightly elongated, that retains the operational components and battery, the housing 31 preferably having beveled or rounded edges. While a sealed transmitter housing 31 may be used, it is preferred that the transmitter 30 be provided with a removable cap 32, for example threadingly or friction fitted to the housing 31, to enable the device to be turned off by removing the battery or breaking the connection to the battery, and to enable replacement of the battery when needed. Alternatively, an activation switch 37 and an operation indicator light 38 may also be provided. Mounted on and extending forward from the housing 31 or cap 32 is an elongated shank 34 ending in a barb or hook member 35. The transmitter 30 may further comprise a wire antenna 33 mounted to and extending rearward of the housing 31. Preferably an alignment key or tongue 36 is mounted on the bottom of the housing 31 to insure proper orientation of the housing 31 when it is inserted into the transmitter recess 22 of the adaptor insert member 20, as will be described later. The barb member 35 and shank 34 may be of any configuration suitable for securing the transmitter to the animal after penetration of the barb member 35 through the animal skin and tissue. For example, the barb member 35 may have a configuration similar to a standard arrowhead, as shown in the drawings, or may have a configuration similar to a fishhook, whereby the barb member 35 easily penetrates in the forward direction but resists removal in the rearward direction.

The adaptor insert member 20 is illustrated in FIGS. 4 through 7. The adaptor insert member 20 comprises an elongated, aerodynamically shaped main body 21, preferably cylindrical. The main body 21 may have a constant diameter or be tapered on its forward portion as shown. A transmitter recess or receptacle 22 is disposed in the main body 21, the recess 22 having an open top 23. The recess 22 is sized correspondingly to the dimensions of the transmitter housing 31, and end cap 32 if present, such that the transmitter housing 31 is insertable into the recess 22, the recess 22 preferably being sized most preferably such that the transmitter housing 31 does not extend beyond the outer circumference of the main body 21. The recess 22 dimensions must be slightly greater than the dimensions of the housing 31 to allow the housing 31 to be pulled from the recess 22 when the arrow 10 strikes the animal. The recess snuggly and securely receives and retains the transmitter housing 31 in a friction fit such that the housing 31 remains in the recess 22 during normal handling and when an arrow is shot from a bow. Preferably the adaptor insert member 20 further comprises an alignment slot 24 configured to receive the alignment key 36 of the transmitter 30. The combination of the alignment slot 24 and alignment key 36 insures that the transmitter 30 is properly oriented in the adaptor insert member 20. The walls of the recess 22 may be rounded, curved or angled to better conform to the configuration of the transmitter housing 31. The forward and rear walls of the recess 22 may be curved, angled or sloped such that the recess 22 is longer at the top than at the bottom to allow the transmitter 30 to more easily exit the recess 22 when the animal is struck.

The forward end 25 of the adaptor insert member 20 is provided with adaptor female connector means 26 for releasably receiving the arrowhead male connector means 14, the adaptor female connector means 26 being sized and configured to functionally match the shaft female connector means 12. Preferably the adaptor female connector means 26 comprises an internally threaded socket. The rearward end 27 of the adaptor insert member 20 is provided with adaptor male connector means 28 for insertion into the shaft female connector means 12, the adaptor male connector means 28 being sized and configured to functionally match the arrowhead male connector means 14. Preferably the adaptor male connector means 28 comprises an externally threaded rod. In this manner the adaptor insert member 20 can be utilized with conventional arrowheads 13 and shafts 11, such that the adaptor insert member 20 is positionable between the arrowhead 13 and the shaft 11 as shown in FIG. 1.

To utilize the device, the adaptor insert member 20 is connected to a conventional arrow shaft 11 and a conventional arrowhead 13 is connected to the front of the adaptor insert member 20, typically by threading the adaptor insert member 20 onto the shaft 11 and threading the arrowhead 13 onto the adaptor insert member 20. The transmitter housing 31, and end cap 32 if present, is then inserted into the recess 22 such that the alignment key 36 fits into the alignment slot 24, the shank 34 and barb member 35 extend forward from the recess 22, and the wire antenna 33 extends rearward from recess 22. The free end of wire antenna 33 is preferably taped to the shaft 11 so as not to impact the arrow flight path. With the transmitter 30 activated, a locator signal is now transmitted which is received by a radio receiver carried by the hunter. As the arrow 10 strikes and penetrates the skin and tissue of a game animal, the transmitter barb member 35 also penetrates the skin and tissue. As the arrow 10 continues forward, the barb member 35 snags such that the transmitter housing 31 is forcefully pulled from the adaptor insert member recess 22, thereby separating the transmitter 30 from the adaptor insert member 20 and the arrow 10. Because the barb member 35 is positioned just behind or even equal to part of the arrowhead 13, the barb member 35 will snag the tissue or skin of the animal even if the arrow 10 only penetrates slightly. In this manner, the transmitter 30 remains affixed to the game animal regardless of whether the arrow 10 remains affixed. If the animal is only wounded and is able to flee, the hunter can track and follow the animal using the locator signal transmitted by the transmitter 30.

It is understood that equivalents and substitutions for certain elements and structures set forth above may be obvious to those of ordinary skill in the art, and therefore the true scope and definition of the invention is to be as set forth in the following claims.

I claim:

1. A hunting arrow game tracking device comprising:

an elongated adaptor insert member comprising a main body having a transmitter recess, a forward end comprising a female connector and a rearward end comprising a male connector;

a transmitter emitting a locator signal, said transmitter comprising a housing and a barb member connected to said housing, said housing temporarily received within said transmitter recess and said barb member positioned externally to said transmitter recess and extending forward;

wherein said housing comprises an axially-oriented alignment key member and said transmitter recess comprises an axially-oriented alignment slot extending longitudinally between said forward end and said rearward end, whereby said alignment key is received by said alignment slot, thereby preventing rotational movement of said housing relative to said transmitter recess;

whereby with said hunting arrow game tracking device mounted between an arrowhead and shaft on an arrow, said barb member embeds in a game animal and said housing is pulled from said transmitter recess when a game animal is struck.

2. The device of claim 1, wherein said female connector comprises an internally threaded socket and said male connector comprises an externally threaded rod.

3. The device of claim 1, wherein said housing comprises a removable cap member.

4. The device of claim 1, wherein said transmitter comprises an antenna.

5. The device of claim 1, wherein said transmitter comprises an activation switch.

6. The device of claim 1, wherein said transmitter comprises an indicator light.

7. The device of claim 1, wherein the walls of said transmitter recess are sloped.

8. A hunting arrow game tracking device in combination with a hunting arrow, said hunting arrow comprising a removable arrow having a male connector and a shaft having a female connector adapted to receive said arrow male connector, said device comprising:

an elongated adaptor insert member comprising a main body having a transmitter recess, a forward end comprising a female connector and a rearward end comprising a male connector, said adaptor insert member female connector receiving said arrow male connector and said adaptor insert member male connector being received by said shaft female connector;

a transmitter emitting a locator signal, said transmitter comprising a housing and a barb member connected to said housing, said housing temporarily received within said transmitter recess and said barb member positioned externally to said transmitter recess and extending forward;

wherein said housing comprises an axially-oriented alignment key member and said transmitter recess comprises an axially-oriented alignment slot extending longitudinally between said forward end and said rearward end, whereby said alignment key is received by said alignment slot, thereby preventing rotational movement of said housing relative to said transmitter recess;

whereby said barb member embeds in a game animal and said housing is pulled from said transmitter recess when a game animal is struck.

9. The device of claim 8, wherein said female connector comprises an internally threaded socket and said male connector comprises an externally threaded rod.

10. The device of claim 8, wherein said housing comprises a removable cap member.

11. The device of claim 8, wherein said transmitter comprises an antenna.

12. The device of claim 8, wherein said transmitter comprises an activation switch.

13. The device of claim 8, wherein said transmitter comprises an indicator light.

14. The device of claim 8, wherein the walls of said transmitter recess are sloped.

15. A hunting arrow game tracking device comprising:

an elongated adaptor insert member comprising a main body having a transmitter recess with sloped walls, a forward end comprising an internally threaded female connector and a rearward end comprising an externally threaded male connector;

a transmitter emitting a locator signal, said transmitter comprising a housing, an antenna connected to said housing and a barb member connected to said housing, said housing temporarily received within said transmitter recess and said barb member positioned externally to said transmitter recess and extending forward;

wherein said housing further comprises a removable cap member and an axially-oriented alignment key member and said transmitter recess comprises an axially-oriented alignment slot extending longitudinally between said forward end and said rearward end, whereby said alignment key is received by said alignment slot, thereby preventing rotational movement of said housing relative to said transmitter recess;

whereby with said hunting arrow game tracking device mounted between an arrowhead and shaft on an arrow, said barb member embeds in a game animal and said housing is pulled from said transmitter recess when a game animal is struck.

16. The device of claim 15, wherein said transmitter comprises an activation switch.

17. The device of claim 15, wherein said transmitter comprises an indicator light.

* * * * *